US005692646A

United States Patent [19]

Ota et al.

[11] Patent Number: 5,692,646

[45] Date of Patent: Dec. 2, 1997

[54] CARTRIDGE HAVING CLOSURE MEMBER FOR STORING A VISCOUS SUBSTANCE

[75] Inventors: Yoshio Ota, Sendai; Kouji Ono, Shibata-gun, both of Japan

[73] Assignee: Tohoku Ricoh Co., Ltd., Miyagi-ken, Japan

[21] Appl. No.: 421,966

[22] Filed: Apr. 14, 1995

[30] Foreign Application Priority Data

| | | | |
|---|---|---|---|
| Sep. 21, 1994 | [JP] | Japan | 6-226326 |
| Nov. 17, 1994 | [JP] | Japan | 6-283554 |
| Nov. 21, 1994 | [JP] | Japan | 6-286274 |

[51] Int. Cl.[6] ..... B65D 35/56

[52] U.S. Cl. ..... 222/105

[58] Field of Search ..... 222/105, 386

[56] References Cited

U.S. PATENT DOCUMENTS

| | | | |
|---|---|---|---|
| 4,961,518 | 10/1990 | Shoji et al. | 222/386.5 X |
| 5,156,299 | 10/1992 | De Caluwe et al. | 222/105 X |

FOREIGN PATENT DOCUMENTS

| | | | |
|---|---|---|---|
| 63-56107 | 11/1988 | Japan . | |
| 64-70372 | 3/1989 | Japan . | |
| 4-59226 | 9/1992 | Japan . | |
| 4-339769 | 11/1992 | Japan | 222/105 |

*Primary Examiner*—Gregory L. Huson

*Attorney, Agent, or Firm*—Oblon, Spivak, McClelland, Maier & Neustadt, P.C.

[57] ABSTRACT

An ink cartridge for use with, for example, a stencil printer and storing viscous ink therein is disclosed. The cartridge is free from damage and deformation during storage or transport in various kinds of atmospheres. Particularly, an ink outlet included in the cartridge is prevented from tilting. The cartridge can, therefore, be surely and accurately mounted to an apparatus. The ink outlet is protected from damage even when the cartridge is let fall by accident.

2 Claims, 12 Drawing Sheets

CARTRIDGE HAVING CLOSURE MEMBER FOR STORING A VISCOUS SUBSTANCE

BACKGROUND OF THE INVENTION

The present invention relates to a cartridge for storing a viscous substance and, more particularly, to an ink cartridge for storing ink and removably mounted to a stencil printer or the like.

It has been customary with, for example, a stencil printer to use a removable ink cartridge storing viscous ink therein. The ink cartridge includes a box-like casing, a flexible sack disposed in the casing and filled with ink, a mouth member affixed to part of the sack and having an ink outlet for supplying the ink to the printer, and a cap removably closing the ink outlet. The mouth member protrudes to the outside of the casing. Part of the sack surrounding the mouth member is affixed to the casing by adhesive.

When the sack of the conventional cartridge is filled with ink, the sack bodily expands. In this condition, the cartridge is stored with the ink outlet facing upward. This brings about a drawback that not only the rigidity of the casing decreases, but also a force attributable to the weight of the ink acts on the bottom of the sack and, therefore, the bottom of the casing. As a result, the casing is distorted, and the sack is deformed. This causes a tension to act on part of the ink outlet of the mouth member. Moreover, because the upper surface of the casing and the open end of the cap facing it are spaced apart from each other, it is likely that the outlet tilts itself and prevents the cartridge from being accurately mounted to the printer, while degrading the appearance of the cartridge. This often occurs particularly during storage or transport in a hot and humid environment. In addition, when the cartridge is let fall by accident, the ink outlet of the mouth piece is easily damaged.

SUMMARY OF THE INVENTION

It is, therefore, an object of the present invention to provide a cartridge for storing a viscous substance and scarcely deformed or damaged when stored or transported in various kinds of environments.

It is another object of the present invention to provide a cartridge for storing a viscous substance and capable of preventing an ink outlet thereof from tilting.

It is still another object of the present invention to provide a cartridge for storing a viscous substance and capable of protecting an ink outlet thereof from damage even when let fall by accident.

It is a further object of the present invention to provide an ink cartridge capable of being removably mounted to a stencil printer for supplying ink thereto.

In accordance with the present invention, a cartridge for storing a viscous substance has a box-like casing, a flexible sack disposed in the casing and filled with the viscous substance, a mouth member affixed to the sack and protruding from the casing and formed with an ink outlet for discharging the viscous substance, and a closure member having an open end and for closing the ink outlet of the mouth member. The open end of the closure member and the outer periphery of the top wall of the casing, facing the open end and on which the closure member is fitted, contact each other.

Also, in accordance with the present invention, a cartridge for storing a viscous substance has a box-like casing, a flexible sack disposed in the casing and filled with the viscous substance, a mouth member affixed to the sack and protruding from the casing and formed with an ink outlet for discharging the viscous substance, and a closure member having an open end and for closing the ink outlet of the mouth member. The open end of the closure member and the outer periphery of the top wall of the casing, facing the open end and on which the closure member is fitted, does not contact each other.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
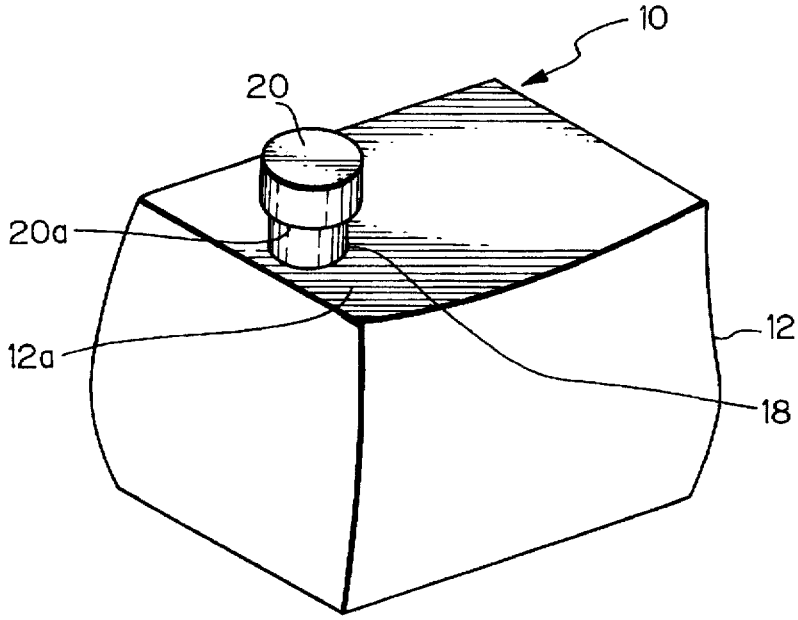
Fig. 1 PRIOR ART
FIG. 1 is an external perspective view of a conventional ink cartridge.

To better understand the present invention, a brief reference will be made to a conventional cartridge, shown in FIGS. 1 and 2. The cartridge is implemented as an ink cartridge for use with a stencil printer by way of example. As shown, the cartridge, generally 10, includes a box-like casing 12. A flexible sack 14 is disposed in the casing 12 and filled with viscous ink 16. A mouth member 18 is affixed to part of the sack 14 and formed with an ink outlet 18*a* for supplying the ink 16 to the printer. The ink outlet 18*a* is closed by a removable cap 20. The mouth member 18 protrudes to the outside of the casing 12. Part of the sack 14 surrounding the mouth member 18 is affixed to the inner periphery of the casing 12 by adhesive 22 at the outer periphery thereof. The cap 20 has an open end 20*a* facing the outer periphery of the top wall 12*a* of the casing 12. The open end 20*a* of the cap 20 and the surface 12*a* of the casing 12 are spaced apart from each other by a gap G.

During storage or transport, the cartridge 10 is positioned such that the top 12*a* of the casing 12, i.e., the ink outlet 18*a* of the mouth member 18 faces upward. This, however, brings about the following problems. The viscous ink 16 filled in the sack 14 sequentially moves downward due to its own weight, exerting a force on the bottom of the sack 14, i.e., the bottom of the casing 12. As a result, it is likely that the sack 14 is deformed, or the casing 12 is distorted. The deformation or distortion even affects the ink outlet 18*a* of the mouth member 18. Particularly, the mouth member 18 tilts, as illustrated in FIG. 1, due to the gap G between the top 12*a* of the casing 12 and the open end 20*a* of the cap 20. This not only prevents the cartridge 10 from being accurately mounted to the printer, but also degrades the appearance of the cartridge 10. This kind of occurrence is particularly conspicuous in a hot and humid environment. Moreover, when the cartridge 10 having the above configuration is let fall by accident, the mouth member 18 is apt to break.

Preferred embodiments of the present invention which are free from the problems discussed above will be described hereinafter. Each embodiment to be described is also implemented as an ink cartridge applicable to a stencil printer. In the embodiments, the same or similar constituent parts as or to the parts shown in FIGS. 1 and 2 are designated by the same reference numerals, and a detailed description thereof will not be made in order to avoid redundancy.

Figure 2:
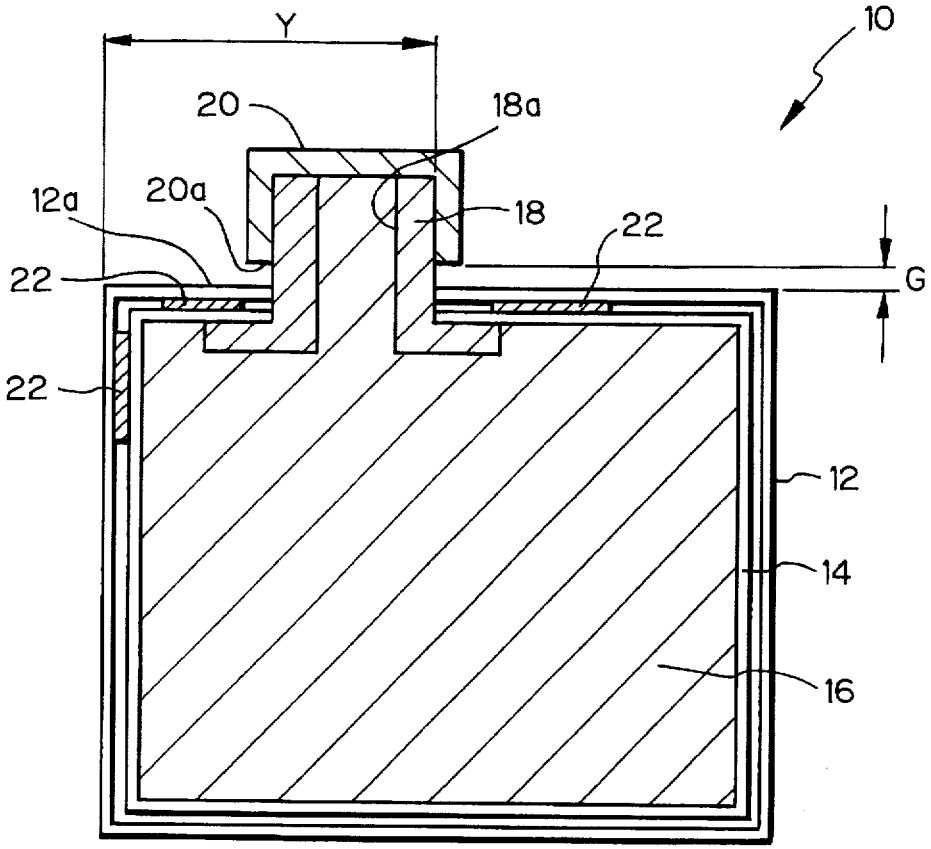
Fig. 2 PRIOR ART
FIG. 2 is a section of the conventional ink cartridge.
Figure 3:
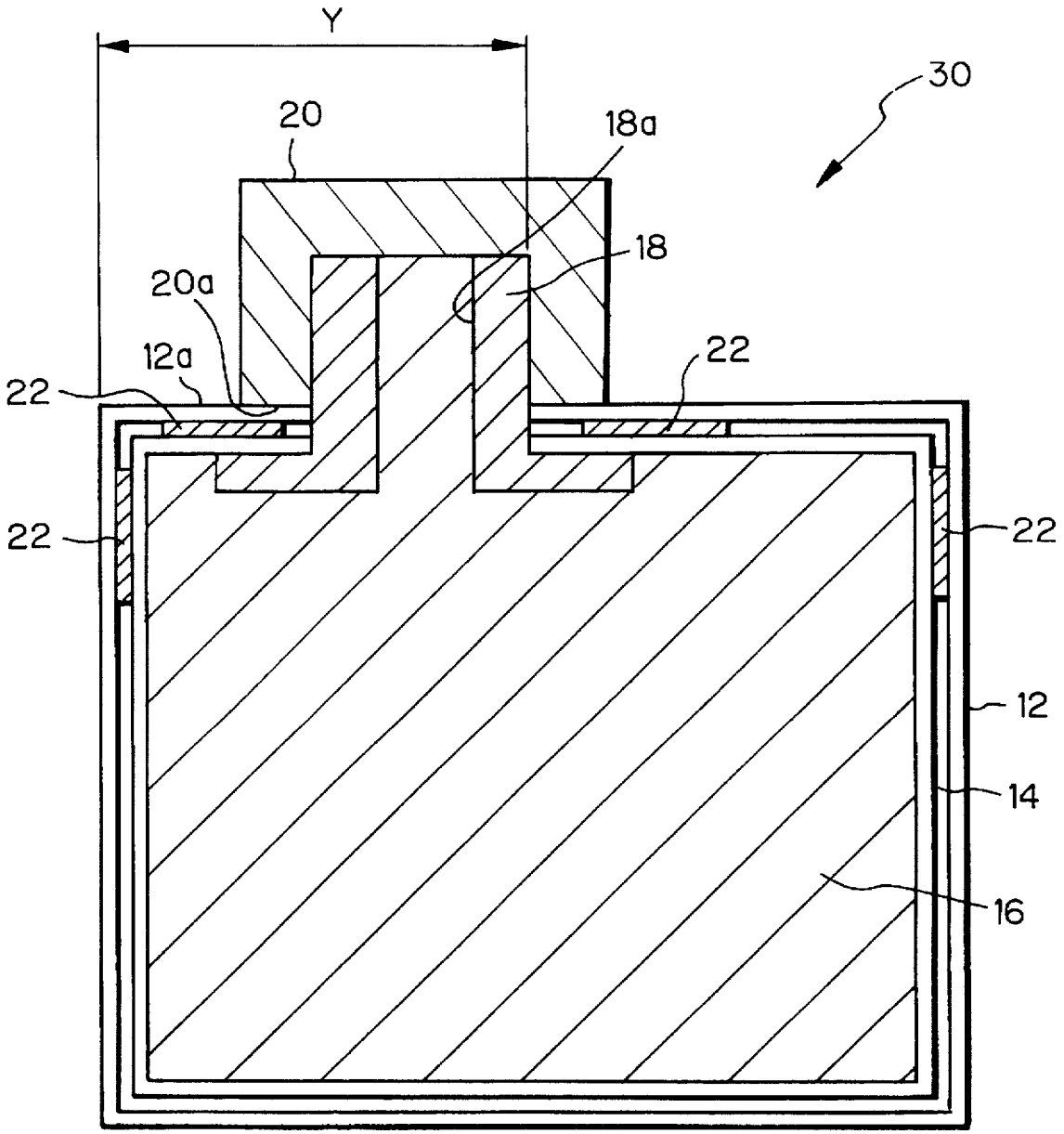
FIG. 3 is a section showing a first embodiment of the ink cartridge in accordance with the present invention.

Referring to FIG. 3, a first embodiment of the ink cartridge in accordance with the present invention is shown and generally designated by the reference numeral 30. As shown, the cartridge 30 includes a cap 20 having an open end 20*a*, and a casing 12 having an top wall whose outer periphery is labeled 12*a*. The cap open end 20*a* and the casing outer periphery, or upper surface, 12*a* contact each other, i.e., the gap G shown in FIGS. 1 and 2 is absent. When a sack 14 expands due to viscous ink 16 introduced therein, a force sequentially acts on the bottom of the sack 14 and, therefore, the bottom of the casing 12 due to the weight of the ink 16. In this condition, the sack 14 may be deformed, or the casing 12 may be distorted. Although the deformation or distortion may cause tension to act on part of the ink outlet 18*a* of a mouth member 18, it is absorbed by the upper surface 12*a* of the casing 12 and the open end 20*a* of the cap 20 contacting each other. Hence, the mouth member 18 and, therefore, the ink outlet 18*a* thereof is prevented from tilting.

Figure 4:
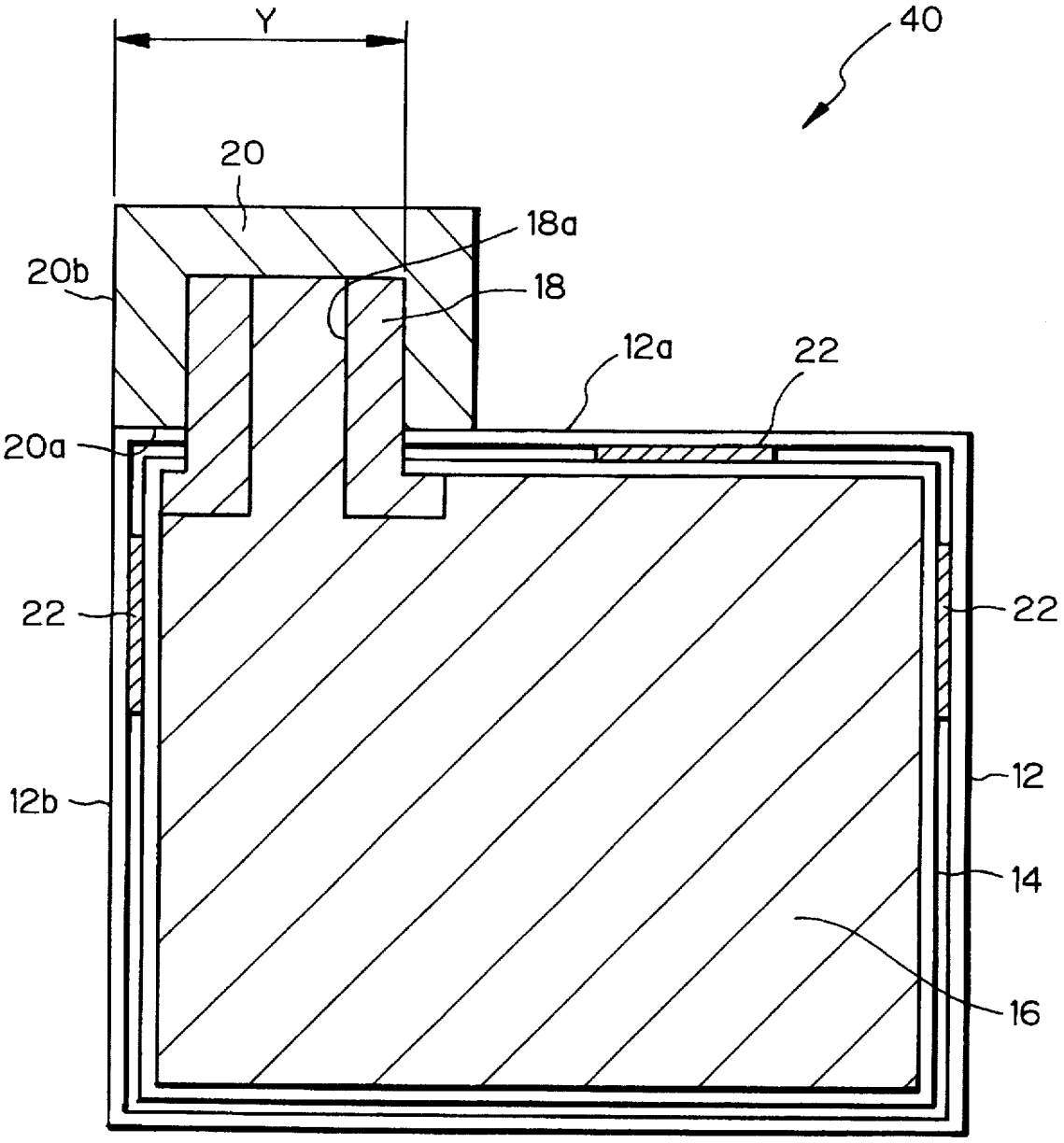
FIGS. 4 and 5 are sections respectively showing a second and a third embodiment of the present invention.

FIG. 4 shows a second embodiment of the present invention. Briefly, in this embodiment, the mouth member 18 is affixed to the casing 12 and sack 14 at a different position from the mouth member 18 of the first embodiment. Specifically, as shown in the figure, the mouth member 18 is positioned such that the outer periphery of the cap 20 has part 20*b* thereof lies in the same plane as the outer periphery 12*b* of at least one side wall of the casing 12. In this configuration, even when tension acts on part of the ink outlet 18*a* of the mouth member 18 due to the deformation of the sack 14 or the distortion of the casing 12, the upper surface 12*a* of the casing 12 and the open end 20*a* of the cap 20, contacting each other, absorb the tension and prevent the outlet 18*a* from tilting. Further, even when the cartridge 40 is laid down such that the outer periphery, or side surface, 12*b*, for example, faces downward, the part 20*b* of the outer periphery of the cap 20 also faces downward in the same plane as the surface 12*b*. As a result, the mouth member 18 and, therefore, the ink outlet 18*a* thereof is prevented from tilting.

Figure 5:
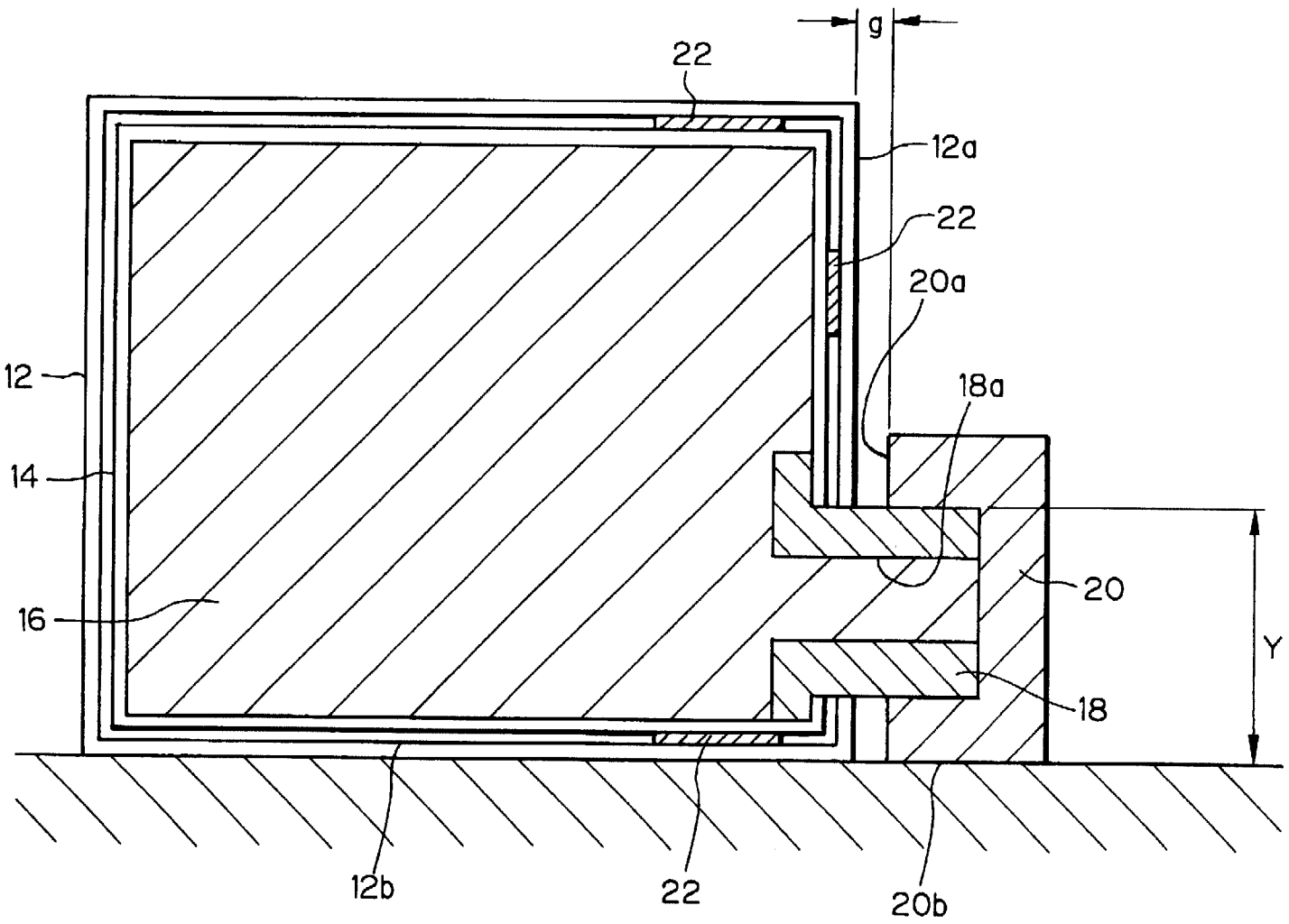

A third embodiment of the present invention is shown in FIG. 5. As shown, an ink cartridge 50 has a gap g between the open end 20*a* of the cap 20 and the upper surface 12*a* of the casing 12, as in the conventional cartridge 10 shown in FIGS. 1 and 2. Tension may act on part of the opening 18*a* of the outlet member 18 due to the deformation of the sack 14 or the distortion of the case 12. However, only if the cartridge 50 is laid down such that the surface 12*b* of the casing 12 and the surface 20*b* of the cap 20 face downward, the mouth member 18 and, therefore, the ink outlet 18*a* is preventing from tilting.

In the first to third embodiments described above, the casing 12, sack 14, mouth member 18 and cap 20 are each made of a conventional material. For example, the casing 12 may be formed of coated cardboard, corrugated cardboard, or resin. The sack 14 may be implemented by a plastic film having one or more layers, or a laminate film consisting of plastic and paper or metal foil. The outlet member 18 and cap 20 may each be implemented as a plastic molding. As for the cap 20, there should preferably be used a material which is easy to shape, scarcely deformable, and light weight.

The conventional ink cartridge 10 of FIGS. 1 and 2 and the ink cartridges 30, 40 and 50 of FIGS. 3, 4 and 5 were left at a temperature of 50° C. and a relative humidity of 90% for three days. As a result, the cartridges 10, 30, 40 and 50 each changed in dimension Y, as follows.

(1) In the "vertical position" shown in FIGS. 1–4

Cartridge 10 +5.2 mm

Cartridge 30 +0.4 mm

Cartridge 40 +0.3 mm

Cartridge 50 +4.8 mm (2) In the "horizontal position" shown in FIG. 5

Cartridge 10 −4.6 mm

Cartridge 30 −1.4 mm

Cartridge 40 −0.2 mm

Cartridge 50 −0.2 mm

Figure 6A:
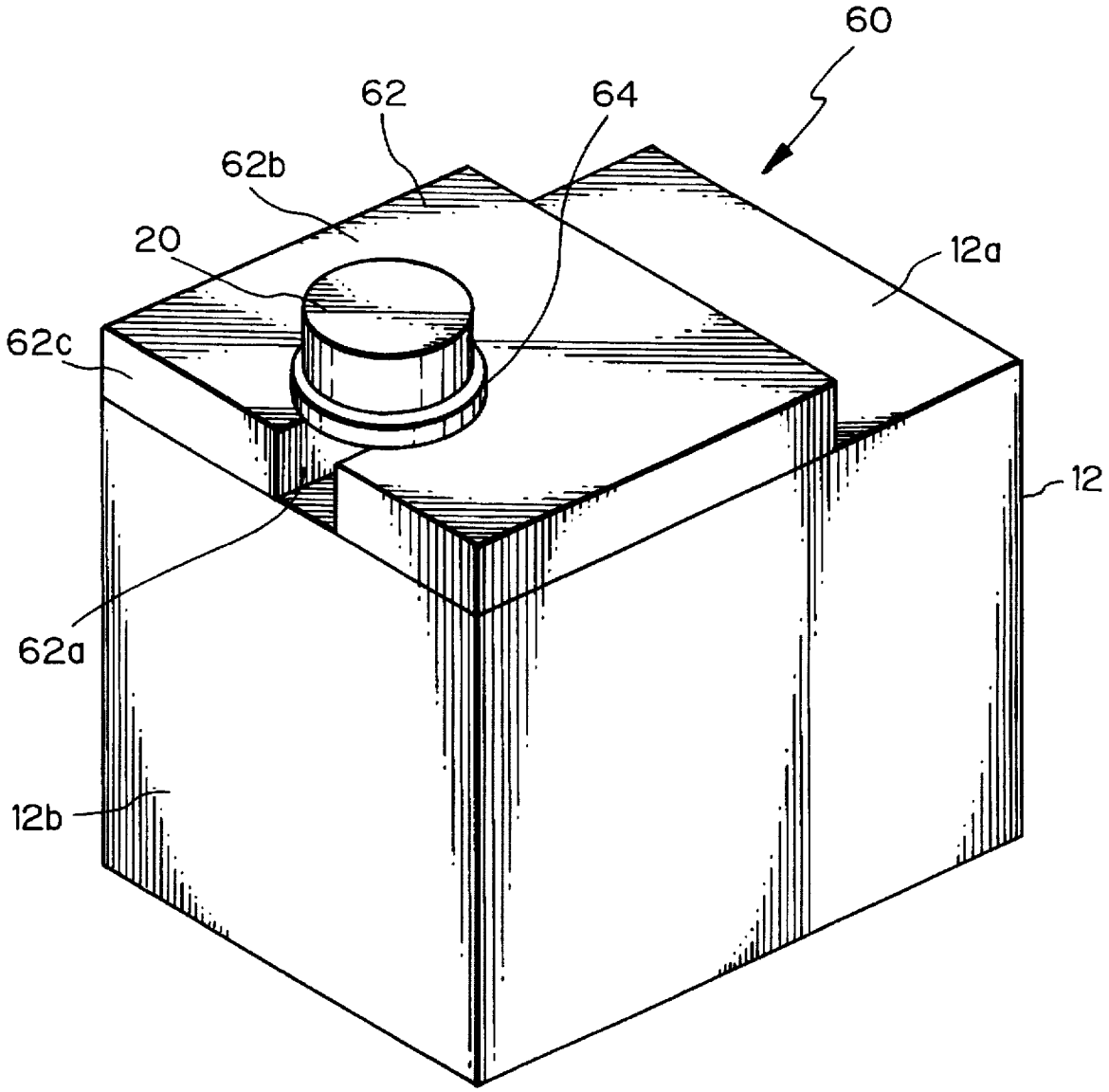
FIGS. 6A and 6B are respectively an external perspective view and a section showing a fourth embodiment of the present invention.
Figure 6B:
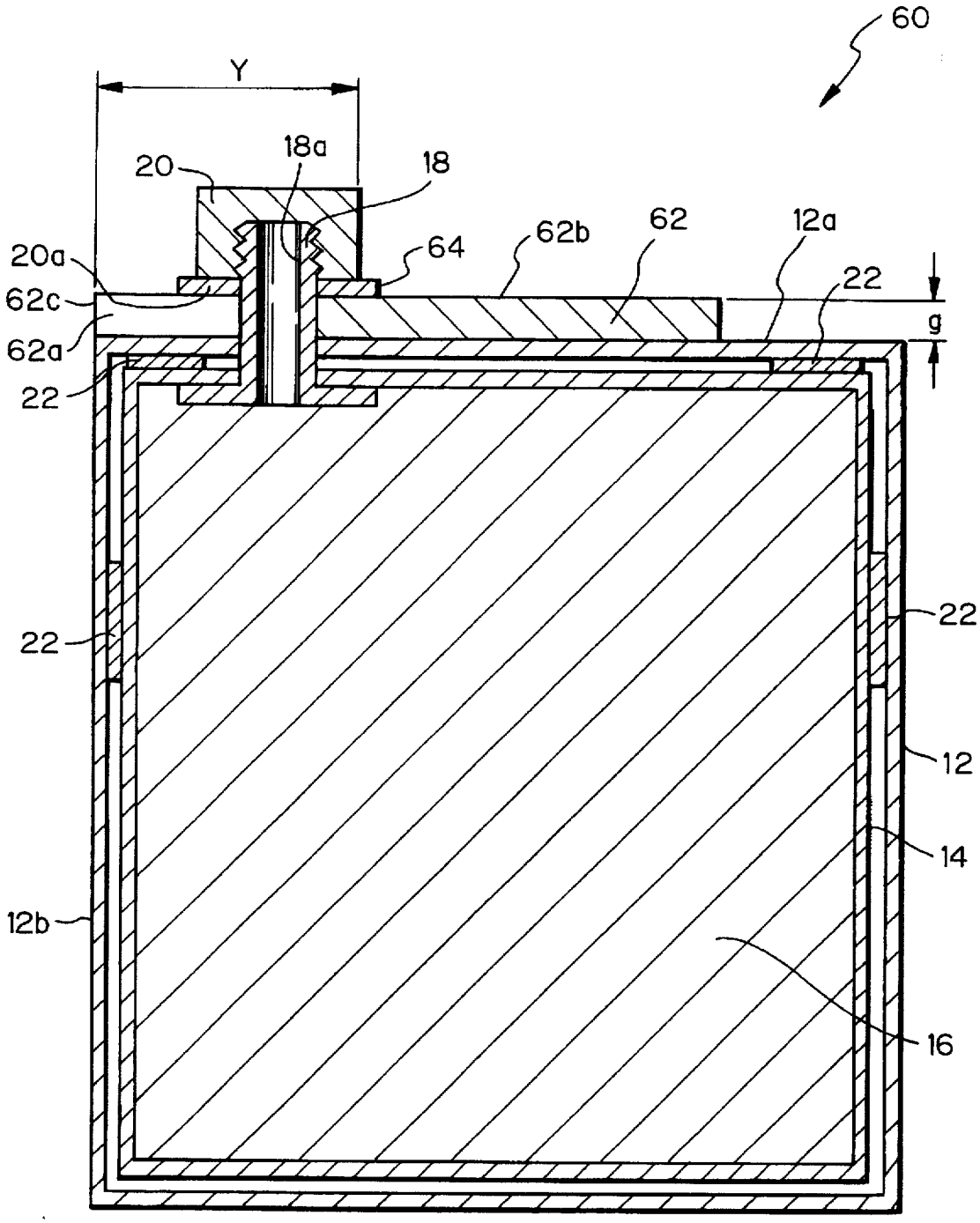
Figure 7:
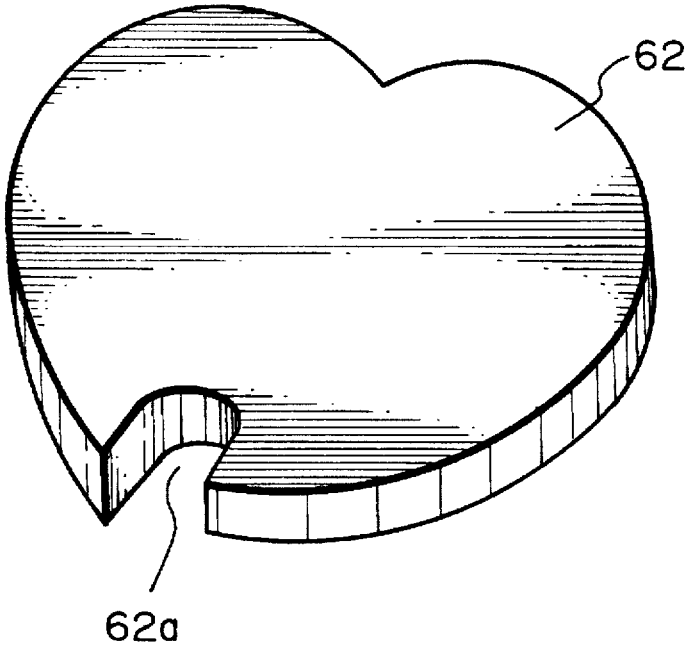
FIGS. 7 and 8 are external perspective views each showing a modification of a deformation preventing plate included in the fourth embodiment.
Figure 8:
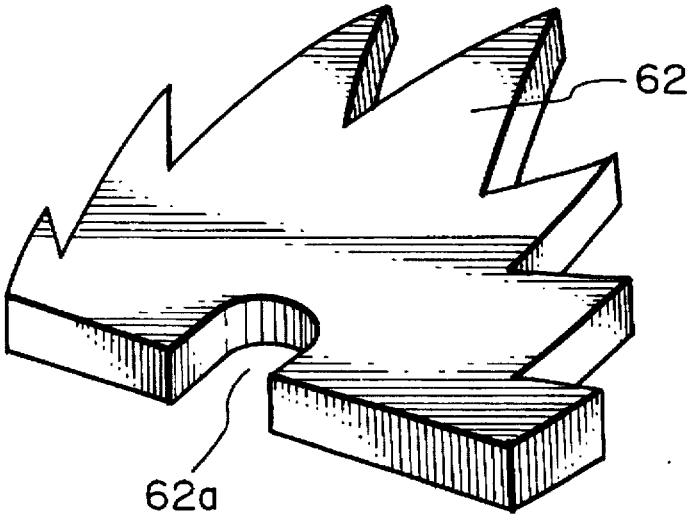

Referring to FIGS. 6A and 6B, a fourth embodiment of the present invention will be described. As shown, an ink cartridge 60 includes a rectangular deformation preventing plate 62 removably fitted in the gap g between the open end 20*a* of the cap 20 and the upper surface 12*a* of the casing 12. The deformation preventing plate 62 is formed with a notch 62*a* for receiving the mouth member 18. The cap 20 is fitted on the mouth member 18 such that the open end 20*a* thereof contacts the upper surface 62*b* of the plate 62. Further, a flange member 64 is affixed to the outlet member 18 to allow the cartridge 60 to be surely fixed in place on the printer The upper surface 62*b* of the plate 62 has an area at least greater than the area of the upper surface 12*a* of the casing 12. The plate 62 has a thickness substantially equal to the gap g. The plate 62 is positioned on the casing 12 such that the edge 62 of the thickness portion having the notch 62*a* lies in the same plane as the side surface 12*b* of the casing 12. FIGS. 7 and 8 each shows a modification of the plate 62.

Assume that tension acts on part of the ink outlet 18*a* of the mouth member 18 due to the deformation of the sack 14 or the distortion of the casing 12. Then, the deformation preventing plate 62 fitted in the gap g scatters and absorbs the tension in cooperation with the upper surface 12*a* of the casing 12 contacting it. This successfully prevents the mouth member 18 and, therefore, the ink outlet 18*a* from tilting.

The cartridge 60 may have the casing 12, sack 14, mouth member 18 and cap 20 implemented by the same materials as stated in relation to the first to third embodiments. The deformation preventing plate 62 should preferably be made of resin which is as light as possible. In addition, the material of the plate 62 should preferably have rigidity which is relatively great and changes little in various environments.

While the embodiments are each used in a vertical position with the ink outlet 18*a* facing upward, the mouth member 18 and, therefore, the outlet 18*a* will be prevented from tilting even when the embodiments are used in a horizontal position.

A plurality of deformation preventing plates 62 each having a particular thickness and a particular area were prepared, and each was fitted on one ink cartridge 60. The ink cartridges 60 with such plates 62 were left at a temperature of 50° C. and a relatively humidity of 90% for three days in a vertical position. The conventional cartridge 10 shown in FIG. 2 was left in the same environment for three days. Changes in the dimension Y of the cartridges 60, FIG. 6B, and a change in the dimension Y of the cartridge 10 were measured. Assume that the ratio of the thickness of the plate 62 to the gap g is T %, and that the ratio of the area of the upper surface 62*b* of the plate 62 to the upper surface 12*a* of the casing 12 is S %.

(1) Cartridge 60 with T=99% and S=30%: 1.8 mm (2) Cartridge 60 with T=99% and S=50% 1.0 mm (3) Cartridge 60 with T=99% and S=100% 0.5 mm (4) Cartridge 60 with T=80% and S=30% 2.8 mm (5) Cartridge 60 with T=80% and S=50% 2.5 mm (6) Cartridge 10 without plate 62 5.2 mm It will be seen that the cartridge 60 having any one of the above configurations (1)–(5) changes in dimension Y less than the conventional cartridge 10 which lacks the plate 62. In addition, configuration (3) shows that the best result is achievable when the area ratio S is 100%.

Figure 9:
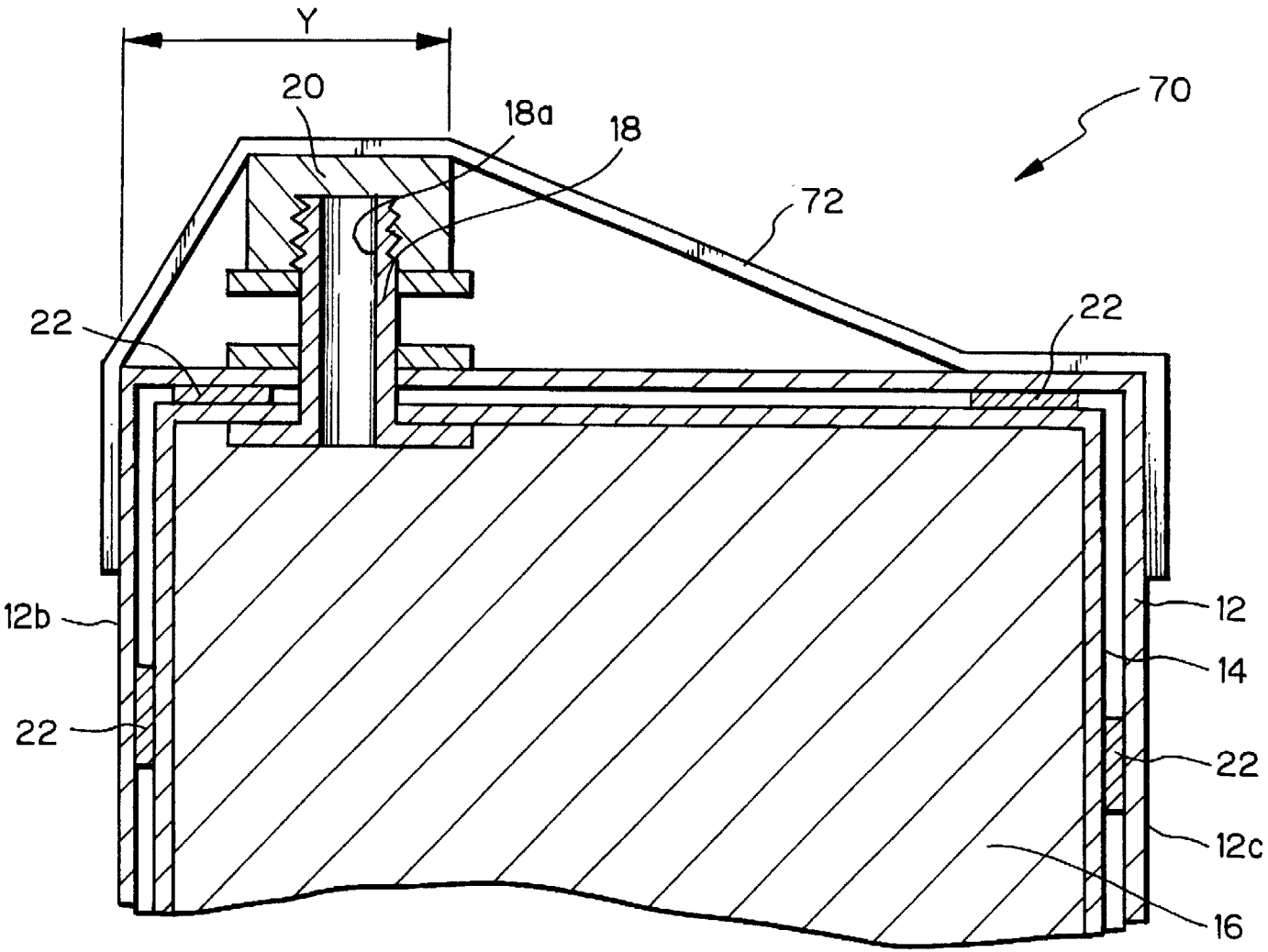
FIGS. 9–13 are sections respectively showing a fifth to a ninth embodiment of the present invention.

FIG. 9 shows a fifth embodiment of the present invention. As shown, an ink cartridge 70 includes an adhesive tape 72 playing the role of an affixing member. After the cap 20 has been fitted on the ink outlet 18*a* of the mouth member 18, the adhesive tape 72 is adhered at one end to the surface 12*b* of the casing 12 and at the other end to a surface 12*c* facing the surface 12*b* . As a result, the mouth member 18 and cap 20 are affixed to the casing 12. To prevent the ink outlet 18*a* from tilting, the tape 72 should preferably be made of Teflon whose dimension is scarcely susceptible in to changes in temperature and stress. The cartridge 70 should only be mounted to the printer after the affixing member 72 has been removed from the cartridge 70.

Figure 10:
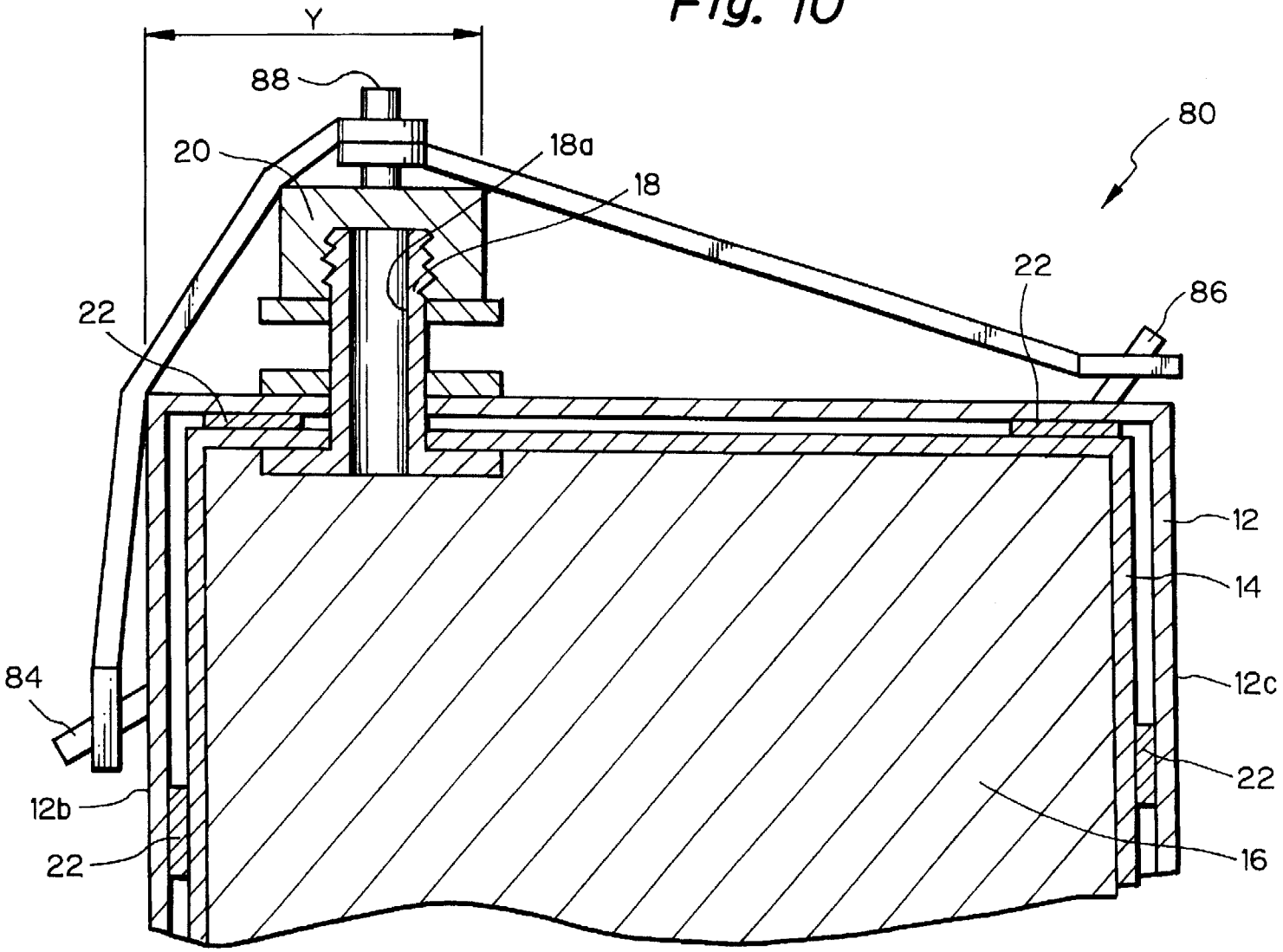
Figure 11:
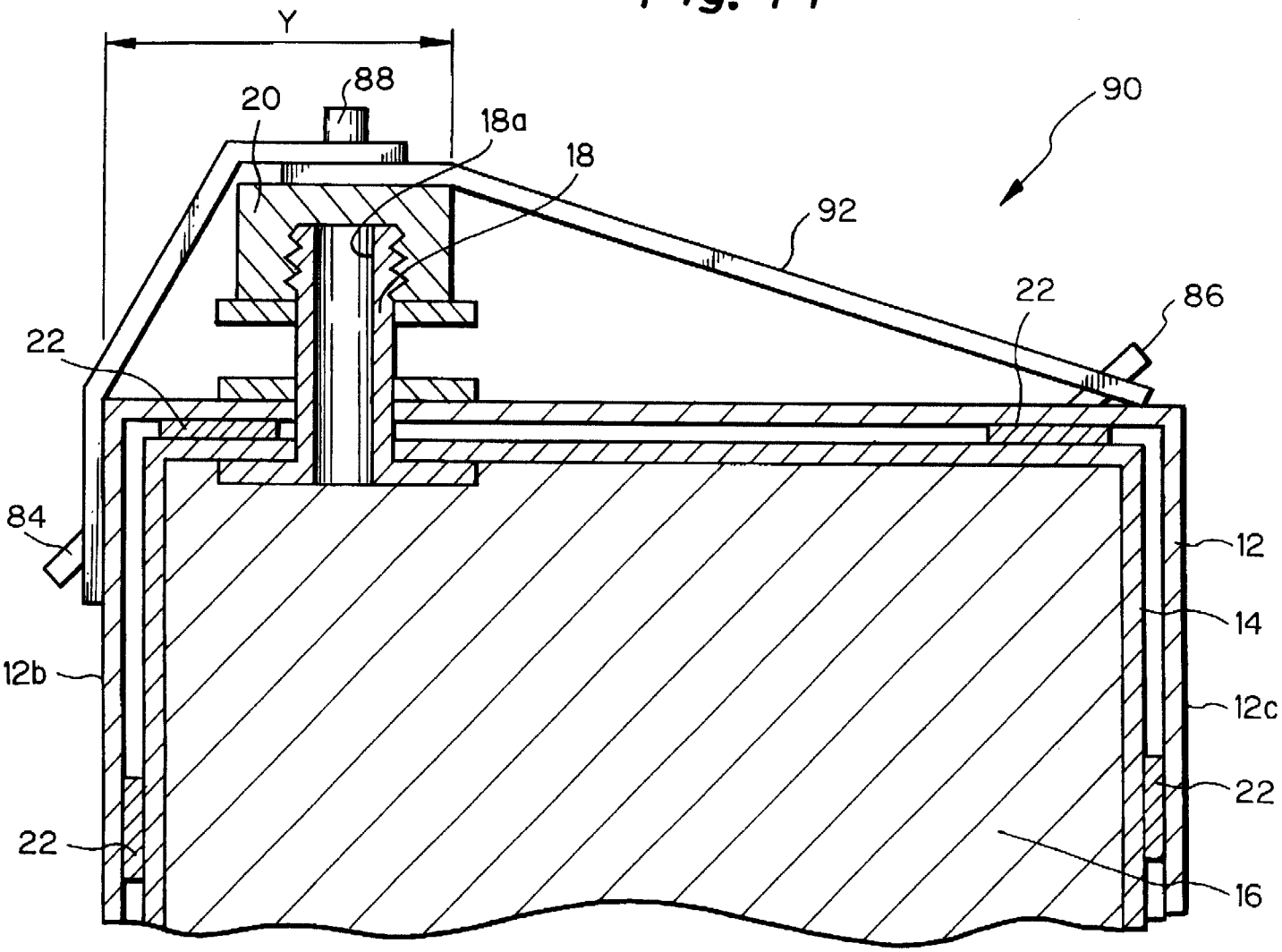
Figure 12:
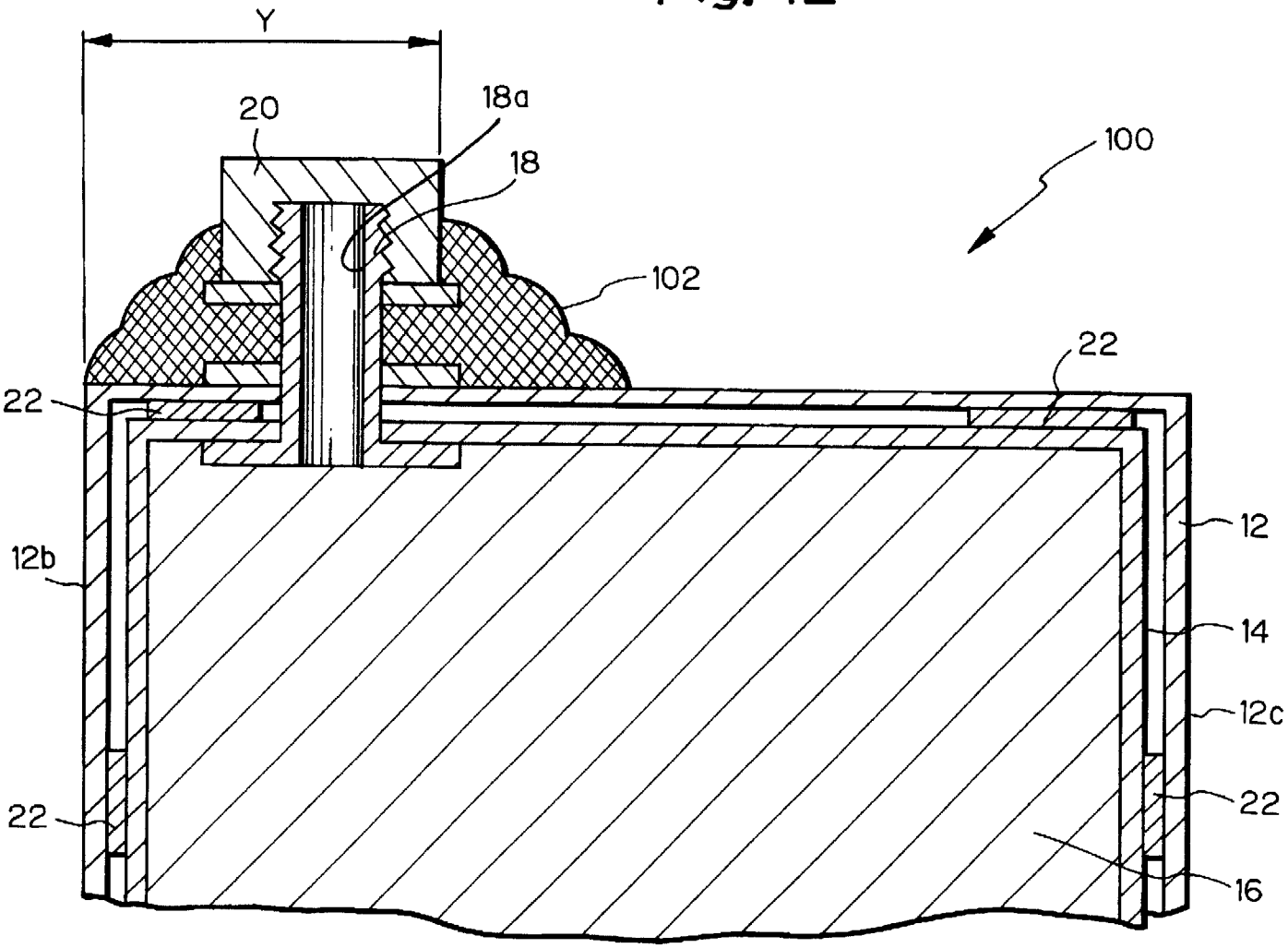
Figure 13:
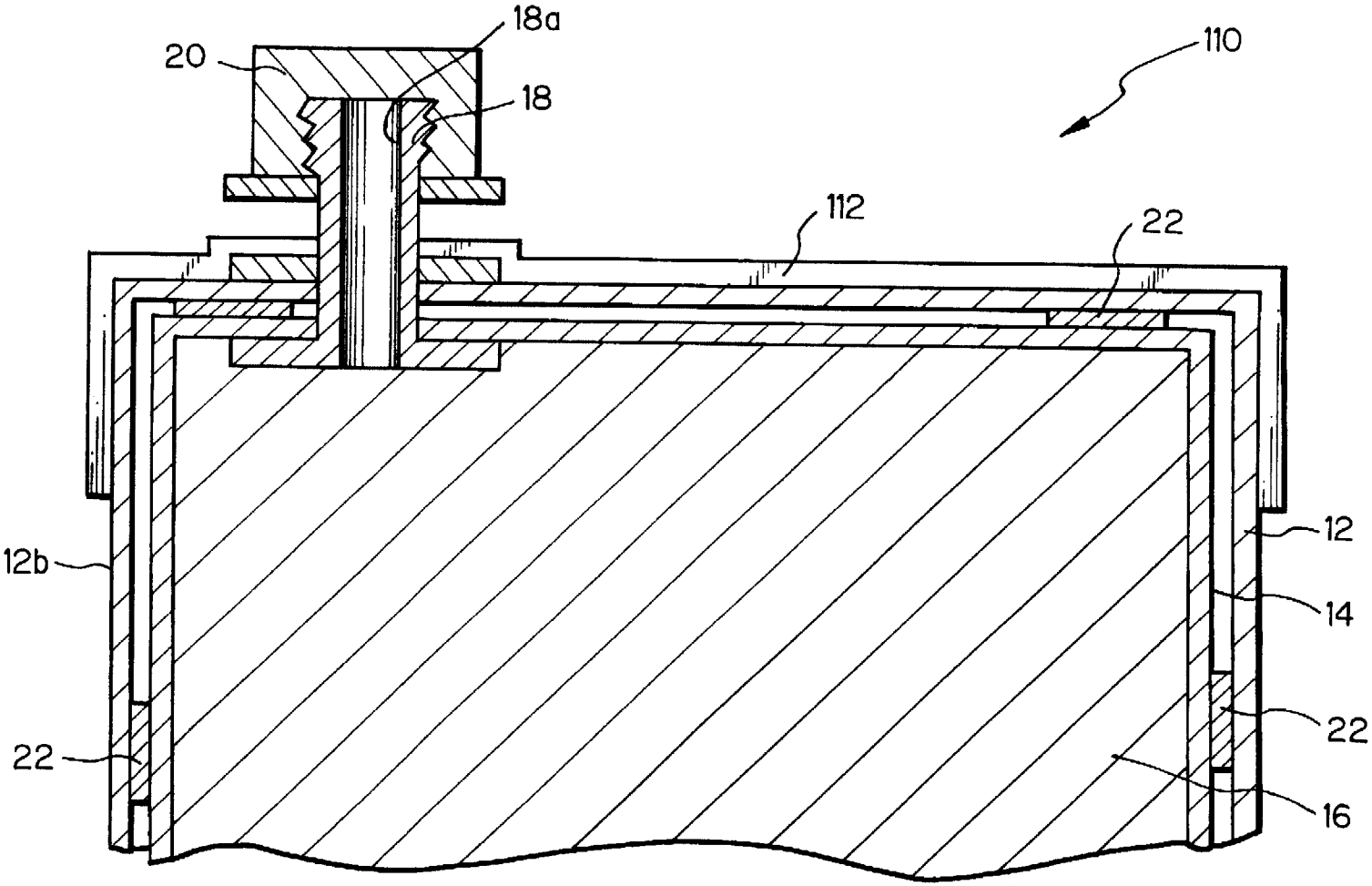

FIGS. 10–13 respectively show a sixth, seventh, eight and ninth embodiment of the present invention, respectively. In FIG. 10, an ink cartridge 80 includes an affixing member 82 implemented as a wire. The wire 82 is affixed to the casing 12 by retainers 84 and 86 at opposite ends and affixed to the cap 20 by a retainer 88. In FIG. 11, an ink cartridge 90 is shown which is essentially similar to the fifth embodiment, FIG. 9, except that the affixing member is implemented as a film 92. In FIG. 12, an ink cartridge 100 similar to the fifth to seventh embodiments except that it has an affixing member 102 implemented as a solidifying substance. Further, in FIG. 13, an ink cartridge 110 includes an affixing member 112 which affixes only the mouth member 18 to the casing 12. The ink cartridge 110 should preferably be implemented by thick paper, sheet of metal of plastic or the like which reduces the tension concentrating on the cap 20 due to the weight of the ink.

Each of the fifth to ninth embodiments, like other embodiments, is capable of preventing the ink outlet 18*a* from tilting even when it is subjected to the local tension attributable to the deformation of the sack 14 or the distortion of the casing 12. This is because the mouth member 18 and cap 20 are firmly affixed to the casing 12 by the affixing member 72, 82, 92, 102 or 112.

The toner cartridges 70, 80, 90, 100 and 100, casing 14, mouth member 18 and cap 20 of the fifth to ninth embodiments may be made of the respective material s described in relation to the first to third embodiments. The cartridges 70, 80, 90 and 100 shown in FIGS. 9, 10, 11 and 12, respectively, and the conventional cartridge 10 shown in FIGS. 1 and 2 were left at a temperature of 30° C. and a relative humidity of 90% for 200 hours. Changes in the dimension Y of the cartridges 70–100 and 10 were measured, as follows.

(1) Cartridge 70 with polypropylene tape 72 3.1 mm (2) Cartridge 70 with Teflon tape 72 2.3 mm (3) Cartridge 80 with polypropylene wire 82 3.2 mm (4) Cartridge 90 with polypropylene film 92 2.2 mm (5) Cartridge 100 with silicone 102 1.8 mm (6) Cartridge 10 without affixing member 5.1 mm While the embodiments have concentrated on an ink cartridge for use with a stencil printer, the present invention is, of course, applicable to any other cartridges for storing fluid substances or viscous substances.

In summary, it will be seen that the present invention provides a cartridge which i s free from damage and deformation during storage or transport in various kinds of atmospheres. Particularly, an ink outlet included in the cartridge is prevented from tilting. The cartridge c a n, therefore, be surely and accurately mounted to a desired apparatus. The ink outlet is protected from damage even when the cartridge is let fall by accident.

Various modifications will become possible for those skilled in the art after receiving the teachings of the present disclosure without departing from the scope thereof.

What is claimed is:

1. A cartridge for storing a viscous substance, comprising:

a box-like casing;

a flexible sack disposed in said casing and filled with the viscous substance;

a mouth member which is movable with respect to said box-like casing, said mouth member being affixed to said sack and protruding from said casing and formed with an ink outlet for discharging the viscous substance; and a closure member removably fittable to said mouth member and having an open end, said closure member closing said ink outlet of said mouth member when said closure member is fitted to said mouth member;

wherein said open end of said closure member and an outer periphery of a top wall of said casing, facing said open end and on which said closure member is fitted, contact each other.

2. A cartridge as claimed in claim 1, wherein said mouth member is affixed to said sack such that an outer periphery of said closure member partly lies in a same plane as an outer periphery of any one of walls of said casing other than said outer periphery of said top wall.

* * * * *